United States Patent [19]

Lemaire et al.

[11] Patent Number: 4,545,269

[45] Date of Patent: Oct. 8, 1985

[54] MACHINE TO APPLY A SCREWING OR UNSCREWING TORQUE

[75] Inventors: Marc Lemaire, Carquefou; Roland Le Roc'h, St. Sebastien sur Loire, both of France

[73] Assignee: Brissonneau et Lotz Marine, France

[21] Appl. No.: 489,459

[22] Filed: Apr. 28, 1983

[30] Foreign Application Priority Data

Apr. 30, 1982 [FR] France ..... 82 07541

[51] Int. Cl.[4] ..... E21B 19/16

[52] U.S. Cl. ..... 81/57.34; 81/57.19; 81/57.21

[58] Field of Search ..... 173/163, 164; 81/57.15, 81/57.16, 57.19, 57.21, 57.34, 57.35

[56] References Cited

U.S. PATENT DOCUMENTS

| | | | |
|---|---|---|---|
| 2,453,369 | 11/1948 | Grable et al. | 255/35 |
| 2,705,614 | 4/1955 | McKibben et al. | 255/35 |
| 3,021,739 | 2/1962 | Grundmann | 81/51.35 |
| 3,041,901 | 7/1962 | Knights | 81/53 |
| 3,680,412 | 8/1972 | Mayer et al. | 81/57.16 |
| 3,838,613 | 10/1974 | Wilms | 173/164 |
| 3,902,385 | 9/1975 | Haby | 81/57.34 |
| 4,023,449 | 5/1977 | Boyadjieff | 81/57.16 |
| 4,082,017 | 4/1978 | Eckel | 81/57.16 |

FOREIGN PATENT DOCUMENTS

| | | |
|---|---|---|
| 2081840 | 10/1971 | France . |
| 2301683 | 2/1976 | France . |

*Primary Examiner*—Donald R. Schran
*Assistant Examiner*—James Wolfe
*Attorney, Agent, or Firm*—Rines and Rines, Shapiro and Shapiro

[57] ABSTRACT

A machine to apply screwing and unscrewing torque to successive drilling shafts employs upper and lower claws, one of which is fixed and the other of which rotates through a limited angular range. Each claw comprises a pair of right-angle branches extending oppositely from a base and terminating in spaced relation to provide a permanent opening at one side of the claw opposite to the base. Each claw has a jaw comprising three gripping elements positioned essentially at the vertices of an equilateral triangle, one gripping element being fixed to the base and the other gripping elements being movably mounted on the branches at opposite sides of the opening. One claw comprises a pair of parts relatively movable vertically to form a viewing opening when the machine is not applying torque.

3 Claims, 2 Drawing Figures

MACHINE TO APPLY A SCREWING OR UNSCREWING TORQUE

The present invention regards a machine intended to apply a strong screwing or unscrewing torque, notably for drilling shafts with essentially vertical axis.

A machine of this kind has already been described in the French Pat. No. 2,301,683, but it displays the drawback of being difficult to make completely automatic, due to its design.

However, the operation of unscrewing shaft sections must be repeated a large number of times in succession, when it is necessary, for example, to raise several thousand meters of shaft, to change the bit with which the end of the shaft train is equipped, or to perform measurements in the well, or to encase the well, and then the operation of screwing must be repeated an equal member of times, to lower again into the well all of the shaft sections of the train. It is therefore obvious that an automation of these operations is highly desirable.

The present invention has as its object such an automation machine.

Summarizing the invention, the machine to apply a screwing or unscrewing torque, notably for drilling shafts with essentially vertical axis, and each having at their lower end a threaded conical male section, and at their upper end a complementary threaded conical female section, comprises two claws placed one above the other, and provided with jaws actuated by jacks, and coming to grasp respectively the upper end of the lower shaft and the lower end of the upper shaft, one of the claws being fixed on a frame member, while the other claw is mobile in rotation around the axis of the shafts under the action of a jack connected at one side to the lower claw, and on the other side to the upper claw. Preferably, each set of jaws comprises three elements, arranged essentially at the vertices of an equilateral triangle, two at the respective ends of the branches of the claw, and the third at its base.

Finally, a space is created in the breadth of one of the claws when the machine is not applying a screwing or unscrewing torque.

The invention will be better understood, and its other goals, advantages and characteristics will appear more clearly, through reading the description which follows, to which two plates of drawings are appended.

Figure 1:
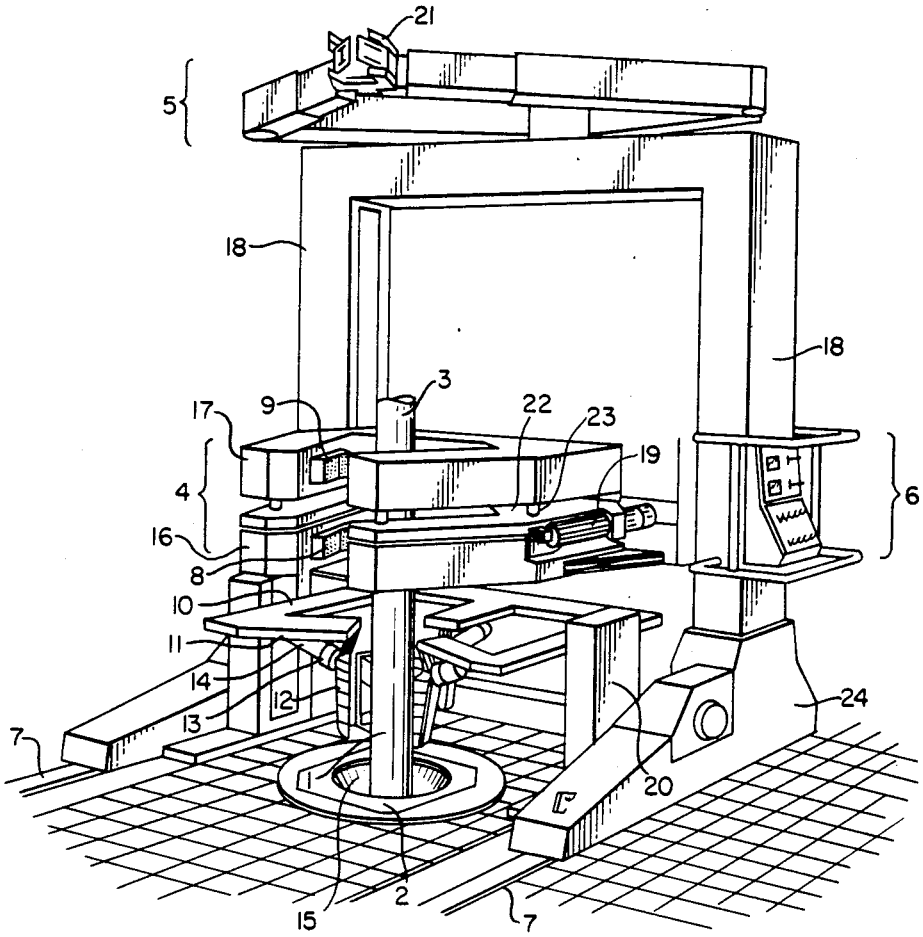
FIG. 1 represents in perspective a complete automatic machine including a machine to apply a screwing or unscrewing torque, conforming to the present invention.

Referring now to FIG. 1, an automatic machine comprises a number of parts functioning in combination. In particular, it comprises a mechanism permitting locking of the shaft 1 projecting from the well at the level of the rotation table 2; it also comprises a machine 4 to apply the initial torque of unscrewing or final torque of screwing to another shaft 3, represented truncated in FIG. 1, at the upper end of the projecting shaft; it also comprises a machine for rapid screwing or unscrewing, not represented in the figure, a claw 5 for positioning the shafts, and finally, an apparatus for control of the assembly, represented here in the form of a control panel 6. The machine is mounted to move in translation on rails 7 provided for this purpose.

In general fashion, when a shaft train is withdrawn from a well, the shaft sections are disattached from one another, and stored on the bed of the drilling unit; to do this, the shaft train is raised so that the shaft section to be unscrewed can be grasped by the elements of the upper claw of the machine for applying torque, and the lower shaft section can be grasped by the elements of the lower claw 16 of the same machine.

At the same time, since it is necessary to lock the lower shaft 1 in order to prevent the entire remaining shaft train from falling into the well when the upper shaft is unscrewed, first the train is lifted higher, to permit the locking mechanism to grasp the lower shaft 1. This mechanism is constituted by a plate 10 provided with arms 11, to each of which is attached a wedge 12, through the intermediary of a hinge 13 and jack 14, capable of moving vertically. By actuating the jacks 14, there results a clamping of the wedges 12 against the shaft 1, at the same time ensuring auto-centering of the wedges. Then the plate 10 is lowered, for example by gravity under the weight of the shaft train, and the wedges 12 penetrate into the opening 15 of complementary form arranged for this purpose in the rotation table 2, which ensures a tight gripping of the wedges 12 against the shaft 1, the upper end of which furthermore displays a greater external diameter than the rest of the body of the shaft, by way of additional security, and locking of the shaft 1.

When the wedges 12 are within the opening 15 and the shaft 1 is well locked, the machine 4 can operate to apply an initial torque, enabling the upper shaft 3 to undergo a rotation of an angle of about 30° with respect to the lower shaft 1, in order to begin the process of unscrewing.

As is known, a drilling shaft is provided at its lower end with a threaded conical male section, and at its upper end with a complementary threaded conical female section. The machine is here constituted by two claws 16 and 17 positioned one above the other, both of them provided with a set of jaws, 8 and 9 respectively, whose elements are actuated by jacks, not represented in the figure, placed within the claws. These jaws 8 and 9 come respectively to grasp the upper end of the lower shaft 1 and the lower end of the upper shaft 3.

Each set of jaws comprises three elements arranged essentially at the vertices of an equilateral triangle. Two are placed respectively at the end of each branch of the claw, while the third, placed at the base of the claw, ensures centering of the shaft, and cooperates with the other two to apply the required torque.

The lower claw 16 is fixed to the frame 18, while the upper claw 17 is mobile in rotation around the axis of the shaft 3 under the action of at least one jack 19 connected at one side to the lower claw 16 and at the other side to the upper claw 17, and, preferably, of two jacks. The two claws are mobile in translation along the axis of the shafts in order to enable correct positioning.

In operation, with the wedges 12 well positioned in the opening 15, the jaws 8 and 9 then come to grasp the shafts, as indicated above. Then the jack 19 imparts a relative movement of rotation of about 30° to the two claws 16 and 17. The assembly then returns to the rest position, the jaws 8 and 9, with the jack 19 behind them, having started the unscrewing process by having applied the required torque.

The machine for rapid unscrewing can then operate. This machine has not been represented here, since it is familiar to the man of art.

The claw 5 for positioning of shafts then takes control of the unscrewed shaft 3, to move it to its storage location, with the weight of the shaft being supported, in classical manner, by a cable taken up on the drum of a winch, not represented here.

This cable is then attached to the shaft 1, which is still locked by the wedges 12. Through the action of the winch, the shaft 1 is then raised, to place it in the position occupied by the shaft 3 at the outset of the operation, and to begin the cycle again. As the shaft 1 is raised, the wedges 12 come out of the opening 15. The jacks 12 resume their rest position, which totally frees the wedges with respect to the shaft 1. A system of counterweights and springs, not represented in the figure, but familiar in itself, is arranged in the columns 20 supporting the mobile plate 10, so that at rest, this plate will be in a high position, and the assembly will be ready for a subsequent operating cycle.

It is thus established that the operation of unscrewing can in this way be automated very simply, which permits reducing considerably the personnel of the team charged with the operation, these personnel furthermore no longer having to exert physical efforts.

The same applies to the inverse operation of screwing. The shaft 3 to be screwed is brought above the shaft 1 projecting from the rotation table 2, by means of the cable supporting it, and the positioning claw 5, whose jaws 21 are provided with a sufficient size to enable them to secure the alignment of the two shafts. By action of the winch, the male end of the upper shaft 3 is introduced into the female section of the lower shaft 1.

The rapid screwing machine then operates under the visual supervision of the operator, by means of an opening 22 in the breadth of the upper claw 17 of the machine for applying the final screwing torque. At the end of this process, the opening 22 is eliminated by placing in rest position jacks, not represented in the figure, acting on fingers 23 to slightly raise a portion of the upper claw 17 during the process of rapid screwing, to permit visual monitoring by the operator. The jaws 8 and 9 grasp respectively the upper end of the lower shaft 1 and the lower end of the upper shaft 3, by means of their various components.

Under the action of the jack 19, a final movement of rotation is imparted to the upper shaft 3, in order to ensure a very firm screwing connection by application of torque. Then the jacks resume successively their rest positions, and the opening 22 in the upper claw 17 appears again.

By means of the cable and the winch, the shaft train is then raised to a height sufficient to enable the wedges 12 to come out of the space 15 in the rotation table 2, and the plate 10 automatically resumes its high position, as indicated previously, with the jacks 13 being in rest position. The operator then lowers the shaft train thus assembled, by a height such that when the wedges 12 are again put in place for the subsequent operating cycle, the upper end of the shaft 3, now in the former place of the shaft 1, will be opposite the jaws 8 of the lower claw 16. The operation can then be repeated with a new upper shaft.

In order to free the space when it is not of use to screw or unscrew shaft sections, the entire machine is mounted on a carriage 24 in the form of a rectangle open on one side, and can be moved on rails 7 provided for this purpose on the drilling platform on one side and the other of the rotation table 7. Preferably, the columns 18 supporting the machine for applying torque and the machine for rapid screwing or unscrewing are mounted to be movable in rotation by several degrees around an articulation provided in the carriage 24, in order to permit operation of the machine if the axis of the well, and thus of the shafts, is not exactly vertical, but displays a relatively small angle to the vertical, for example less than 5°. Finally, the machine is designed in such a way that it has an open side to enable it to be brought into place, and without its being necessary to close this open part after it is brought into place.

Figure 2:
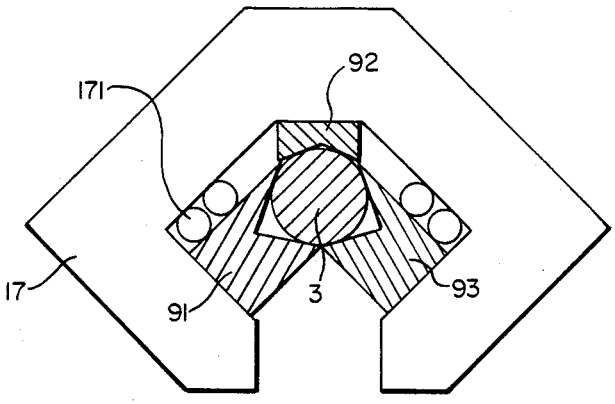
FIG. 2 represents schematically a view from above of a claw equipped with its jaws.

In FIG. 2 has been represented schematically a view from above of a claw 17 with its jaws closed, constituted by its three elements 91, 92, 93 arranged essentially at the vertices of an equilateral triangle.

Preferably, the element 92 is fixed, while the elements 91 and 93 are controlled by jacks. Each branch of the claw has the form of a right angle, in order that the lateral walls of the mobile elements 91 and 93 will be parallel to the branches, which makes it possible to introduce between the walls and the branches an organ 171 for guidance of the elements, to avoid poor centering of the shaft.

Although only one preferred mode of the invention has been described, it is obvious that any modification introduced by the man of art within the same spirit will not constitute a departure from the framework of the present invention.

We claim:

1. A machine to apply screwing and unscrewing torque for drilling shafts and the like with an essentially vertical axis and each provided at opposite ends with threaded portions, an upper threaded portion of each shaft threadedly engaging a lower threaded portion of a successive shaft, said machine having, in combination, a pair of claw means positioned one above the other and provided with jaws having actuating jacks for respectively grasping the upper end of a lower shaft and the lower end of an upper shaft, one of the claw means being fixed to a frame of the machine and the other claw means being mounted for limited angular rotation around the axis of the shafts under the action of at least one jack, each claw means comprising a pair of branches extending oppositely from a base and terminating in spaced relation to define an opening at one side of the claw means opposite to the base, said opening being open at all times, the jaw of each claw means comprising three gripping elements positioned essentially at the vertices of an equilateral triangle, one of said gripping elements being fixed to said base, and the other gripping elements being movably mounted on said branches at opposite sides of said opening and actuated by jacks, each branch having a right-angle configuration interiorly of the associated claw means defined by a pair of substantially perpendicular surfaces, each movable gripping element being mounted on a respective branch for movement in a direction substantially parallel to an associated one of said surfaces of that branch, and guide means being disposed between each movable gripping element and the associated one surface.

2. A machine in accordance with claim 1, wherein one of said claw means comprises a pair of parts that are relatively movable vertically to form a viewing opening therebetween, and wherein said machine includes means for separating said parts to provide said viewing opening when said claw means are not applying screwing or unscrewing torque to shafts.

3. A machine to apply screwing and unscrewing torque for drilling shafts and the like with an essentially vertical axis and each provided at opposite ends with threaded portions, an upper threaded portion of each shaft threadedly engaging a lower threaded portion of a successive shaft, said machine having, in combination, a pair of claw means positioned one above the other and provided with jaws having actuating jacks for respectively grasping the upper end of a lower shaft and the lower end of an upper shaft, one of the claw means being fixed to a frame and the other claw means being mounted for limited angular rotation around the axis of the shafts under the action of at least one jack, one of the claw means being split horizontally to provide a pair of parts that are relatively movable vertically to form a viewing opening therebetween, and wherein said machine includes means for separating said parts to provide said viewing opening when said claw means are not applying screwing or unscrewing torque to shafts.

* * * * *